US008792663B2

(12) United States Patent
Cano et al.

(10) Patent No.: US 8,792,663 B2
(45) Date of Patent: Jul. 29, 2014

(54) HEARING DEVICE WITH AN OPEN EARPIECE HAVING A SHORT VENT

(75) Inventors: Miguel A. Cano, Chicago, IL (US); Mark T. Sodoma, Brookfield, IL (US)

(73) Assignee: GN Resound A/S, Ballerup (DK)

( * ) Notice: Subject to any disclaimer, the term of this patent is extended or adjusted under 35 U.S.C. 154(b) by 1186 days.

(21) Appl. No.: 11/997,738

(22) PCT Filed: Aug. 1, 2006

(86) PCT No.: PCT/EP2006/064900

§ 371 (c)(1),
(2), (4) Date: Jul. 28, 2008

(87) PCT Pub. No.: WO2007/014950

PCT Pub. Date: Feb. 8, 2007

(65) Prior Publication Data

US 2009/0123010 A1 May 14, 2009

Related U.S. Application Data

(60) Provisional application No. 60/704,255, filed on Aug. 1, 2005.

(30) Foreign Application Priority Data

Aug. 1, 2005 (DK) ..... PA 2005 01105

(51) Int. Cl.
*H04R 25/00* (2006.01)

(52) U.S. Cl.
USPC ..... 381/318; 381/328; 381/312; 181/135

(58) Field of Classification Search
USPC ..... 381/312–321, 324, 328; 181/135
See application file for complete search history.

(56) References Cited

U.S. PATENT DOCUMENTS 3,783,201 A * 1/1974 Weiss et al. ..... 381/324
3,935,401 A 1/1976 Shore et al.

(Continued)

FOREIGN PATENT DOCUMENTS

DE 29810947 U1 9/1998
EP 1058479 A2 6/2000

(Continued)

OTHER PUBLICATIONS

International Search Report and Written Opinion dated Apr. 18, 2007 for PCT/EP2006/064900.

(Continued)

*Primary Examiner* — Eugene Lee
*Assistant Examiner* — Fang-Xing Jiang
(74) *Attorney, Agent, or Firm* — Vista IP Law Group, LLP

(57) ABSTRACT

The present application relates to a new type of hearing device housing having a canal section that is adapted for fitting in the ear canal of a wearer and having a short vent, the longitudinal extension of which is shorter than the longitudinal extension of the canal section, and an output port for emission of sound towards the eardrum of the wearer when inserted in the ear canal, and an outer ear section for accommodation of electronic components and being attached to the canal section and adapted for positioning in front of the ear during use, the short vent reducing the occlusion effect, wherein the canal section comprises an open and flexible earpiece manufactured in standard sizes. The hearing device may be a hearing aid, a headset, a headphone, etc. Unlike a conventional BTE (Behind-The-Ear) hearing aid having a housing to be positioned behind the ear, the housing of the hearing device according to the present invention is positioned in front of the ear, i.e. in front of the pinna. The positioning of the hearing device is simple since positioning of the outer ear section is automatically performed together with the positioning of the canal section in the ear canal of the wearer.

23 Claims, 16 Drawing Sheets

(56) References Cited

U.S. PATENT DOCUMENTS

| | | | | |
|---|---|---|---|---|
| 4,375,016 | A | 2/1983 | Harada | |
| 4,878,560 | A | 11/1989 | Scott | |
| 5,046,580 | A | 9/1991 | Barton et al. | |
| 5,201,007 | A | 4/1993 | Ward et al. | |
| 5,619,580 | A | 4/1997 | Hansen | |
| 5,654,530 | A | 8/1997 | Sauer et al. | |
| 5,680,467 | A | 10/1997 | Hansen | |
| 6,359,993 | B2 * | 3/2002 | Brimhall | 381/328 |
| 6,498,858 | B2 | 12/2002 | Kates | |
| 8,096,383 | B2 * | 1/2012 | Saltykov et al. | 181/135 |
| 8,175,308 | B2 * | 5/2012 | Olsen et al. | 381/328 |
| 8,284,974 | B2 * | 10/2012 | Pander et al. | 381/328 |
| 2001/0043707 | A1 | 11/2001 | Leedom | |
| 2002/0085728 | A1 * | 7/2002 | Shennib et al. | 381/328 |
| 2003/0002700 | A1 | 1/2003 | Fretz et al. | |
| 2005/0244026 | A1 * | 11/2005 | Nielsen et al. | 381/380 |

FOREIGN PATENT DOCUMENTS

| | | | |
|---|---|---|---|
| EP | 1448014 | | 8/2004 |
| EP | 1594340 | | 11/2005 |
| WO | 0108443 | A2 | 2/2001 |
| WO | 0203757 | A1 | 1/2002 |
| WO | 2004010734 | A1 | 1/2004 |
| WO | 2004036953 | | 4/2004 |
| WO | 2007014950 | A2 | 2/2007 |
| WO | 2007014950 | A3 | 2/2007 |

OTHER PUBLICATIONS

Written Opinion dated Oct. 4, 2007 for PCT/EP2006/064900.

Preliminary Report dated Dec. 28, 2007 for PCT/EP2006/064900.

Danish Search Report dated Apr. 25, 2006 for PA2005/01105.

International Type Search Report dated Jul. 26, 2006 for DK200501105.

German Patent No. 29810947 was cited in the International Type Search dated Jul. 26, 2006 for DK200501105 (reference above).

Francis Kuk, et al., "Vent Configurations on Subjective and Objective Occlusion Effect", Journal of the American Academy of Audiology, vol. 16, No. 9, 2005, 16 pages.

Francis Kuk, et al., "How do Vents affect Hearing Aid Performance?", Fitting Tips, a tutorial on venting, and its impact on the occlusion effect, hearingreview.com, Feb. 2006, 5 pages.

* cited by examiner

HEARING DEVICE WITH AN OPEN EARPIECE HAVING A SHORT VENT

RELATED APPLICATION DATA

This application is a continuation and National Stage of International Application No. PCT/EP2006/064900, which claims priority to Danish Patent Application No. PA 2005 01105, filed on Aug. 1, 2005, and U.S. Provisional Patent Application No. 60/704,255, filed on Aug. 1, 2005. The entire disclosure of International Application No. PCT/EP2006/064900 is expressly incorporated by reference herein.

FIELD

The present invention relates to a new type of hearing device housing having an open in-the-canal section. The hearing device may be a hearing aid, a headset, a headphone, etc.

BACKGROUND

A conventional in the ear (ITE) or completely-in-the-canal (CIC) hearing aid has a housing that is custom made to individually fit the wearer's ear canal. The hearing aid components, e.g. electronics, microphone, receiver, battery, etc., are contained in the housing which is closed at the end pointing out of the ear by a faceplate. In order to reduce occlusion, a so-called vent, i.e. a ventilation channel, may provide communication between an opening in the faceplate and the wearer's ear canal. The vent may be drilled through the housing or shell, or a pipe or tube extending within the hearing aid and connecting an opening in the faceplate with an opening at the opposite end of the housing may constitute the vent. The effectiveness of the vent increases with increased cross-section and decreased length of the vent channel.

Behind-the-ear (BTE) hearing aids in which a sound tube conducts sound generated by the receiver of the hearing aid into the ear canal are also well known in the art. In order to position the sound tube securely and comfortably in the ear canal, an earpiece is provided for insertion into the ear canal of the user.

Typically, the ITE or CIC housing or the BTE earpiece is individually custom manufactured to fit snugly in the ear canal of the user without causing pain to the wearer while still retaining the housing or earpiece securely in place in the ear canal preventing the earpiece from falling out of the ear irrespective of movements of the wearer, such as chewing or yawning, and also avoiding acoustical feedback generating unpleasant and annoying whistling or howling. The custom made earpiece adds to the cost of the device and the time needed to fit the hearing aid.

Typically, customized devices are made from solid materials to secure retention and tightness. These devices are placed completely or partially in the ear canal. Since the walls of the ear canal are moving when the jaws move for instance when chewing, the placement of such solid devices in the ear canal can be associated with discomfort for the user.

Several approaches to eliminate this discomfort have been tried, one such approach is to make the canal portion of the device in a soft material, e.g. as disclosed in WO 02/03757 A1. Such devices are complicated to manufacture and will only offer limited venting.

In the past non-occluding devices have been built as so-called Helix aids where the bulk of the components are placed in a housing resting in the Concha area of the ear with one extension going into the helix part of the outer ear and another extension going into the ear canal. The extension is so thin that the ear canal is not occluded. Such devices are custom made, not very reliable and costly to manufacture due to the high degree of customization.

Yet another attempt to overcome occlusion is based on the fact that only very little sound is transmitted through the bony parts of the ear canal. By creating a tight seal behind a custom made device and the walls of the ear canal in the bony part of the ear canal, no occlusion effect is experienced by the user. This approach requires the taking of very deep impression of the ear canal and complex manufacturing steps. A fair number of people have ear canals that are too narrow or bend in angles that prevent this solution from being feasible. Also such solutions are quite demanding when it comes to insertion and retraction.

The first thing that people being fitted with a hearing aid note is usually the change of their own voice. They typically describe the sound of their own voice in one of the following terms: "My voice echoes", "My voice sounds hollow" or "I sound like I'm talking in a barrel". Their altered perception of their own voice is mainly due to occlusion of the ear canal by the housing or earpiece.

Sounds originating from the vocal tract (throat and mouth) are transmitted into the ear canal through the cartilaginous tissue between these cavities and the outer portion of the ear canal.

When the ear canal is open, most of this predominantly low frequency sound simply escapes from the ear canal. However, when the ear canal is blocked these bone-conducted sounds cannot escape from the ear canal. The result is a build-up of high sound pressure levels in the residual ear canal volume. This increase in low frequency sound pressure is audible and will cause them to hear their own voice as loud and boomy.

Change in perception of own voice is the most dominant occlusion related complaint, but not the only one. Other occlusion related problems include too much amplification at low frequencies for hearing aid users with good low frequency hearing, reduced speech intelligibility, poorer localization, physical discomfort and increased risk of external ear irritation and infection. Hearing aid users do not adapt to occlusion and the occlusion effect has been cited by as many as 27% of hearing aid wearers as a reason for dissatisfaction with their hearing instruments. This emphasizes the need for alleviating or, even better, eliminating the occlusion effect. The most commonly used method to reduce occlusion-related problems is venting of the otoplastic. While greater (e.g. more open) venting seems to reduce the own voice related occlusion complaint, it creates another problem, namely, a limitation in gain in the high frequencies due to feedback oscillation. Feedback refers to the amplified sound returning to the hearing instrument microphone mainly via the earmould or shell vent or leaks around the earmould or shell. Oscillation arises when the attenuation provided by the feedback path is smaller than the hearing instrument gain. Because greater venting reduces the attenuation in the feedback path, the tendency to feedback oscillation is also increased. This presents a great challenge in providing sufficient high frequency gain.

In WO 2004/010734, a canal hearing device is disclosed having a dual acoustic seal system for preventing feedback while minimizing occlusion effects. The two-part device comprises a main module and an elongated tubular insert for conducting sound to the eardrum and sealing within the bony region of the ear canal. The main module is positioned in the cartilaginous portion of the ear canal. The tubular insert comprises a sound conduction tube and a cylindrically hollow primary seal medially positioned in the bony region. The device also comprises a secondary seal laterally positioned in the cartilaginous region.

WO 01/08443 discloses a one-size-fits-all hearing aid, which is adapted to fit into either ear of an ear canal of a user to a depth proximal to the tympanic membrane. The hearing aid is comprised of two half shells joined together to house the hearing aid components. The joined shells secure a flexible tip at the distal end of the shell.

US 2001/0043707 discloses a hearing aid assembled from three sections. The hearing aid includes a first section having a first housing containing a microphone and electronics, a second section having a second housing containing a battery a flex circuit mounted around the battery and a third section having a compliant tip and a receiver contained within a receptacle in the tip. The tip includes a mushroom shaped portion and a shank or sound port attached to the mushroom shaped portion. The tip can also include a body connected to the sound port. During the manufacturing process, the tip can be formed entirely of silicone rubber. The tip can also be cast in a mold using various durometer rubbers. By selecting the appropriate durometer for the tip and the correct inner diameter and outer diameter ratio of the shank, a spring is not needed within the shank to allow for flexibility of the tip. For example, the mushroom tip can be a very soft 10 durometer; the sound port 40 can be a more stable 40 durometer, and the body, which normally would be a part of the hard shell, a more stable 60 durometer. The ratio of the OD of the shank with respect to the ID of the shank is approximately 2:1. The use of different durometer materials in the tip, along with an appropriate OD to ID ratio, provides flexibility in the tip.

It is an object of the present invention to provide a hearing device wherein at least a part of the hearing device can be securely and comfortably fastened inside the ear canal of a user and that substantially does not cause occlusion of the ear canal.

It is another object of the present invention to provide the hearing device in standard sizes eliminating the need for customization.

According to the present invention, the above and other objects are fulfilled by a hearing device to be worn at the ear with a housing having a canal section that is adapted for fitting in the ear canal of a wearer and having a short vent, the longitudinal extension (i.e., the depth 70) of which is shorter than the longitudinal extension (i.e., the length 72 measured along the longitudinal axis 74) of the canal section, and an output port for emission of sound towards the eardrum of the wearer when inserted in the ear canal, and an outer ear section for accommodation of electronic components and being attached to the canal section and adapted for positioning in front of the ear during use, the short vent reducing the occlusion effect, wherein the canal section comprises an open and flexible earpiece manufactured in standard sizes.

The hearing device may be a hearing aid, a headset, a headphone, etc.

Unlike a conventional BTE (Behind-The-Ear) hearing aid having a housing to be positioned behind the ear, the housing of the hearing device according to the present invention is positioned in front of the ear, i.e. in front of the pinna. The positioning of the hearing device is simple since positioning of the outer ear section is automatically performed together with the positioning of the canal section in the ear canal of the wearer.

In a hearing aid, the hearing aid housing comprises a microphone for converting sound into an audio signal, a signal processor for processing the audio signal into an audiosignal compensating a hearing defect, and a receiver that is connected to an output of the signal processor for converting the processed compensated audio signal into a sound signal.

It is an important advantage of the present invention, that the vent may be very short, namely equal to the thickness of the wall of the canal section at the vent opening.

A venting tube, e.g. inside the canal section, may be provided wherein the inner volume of the tube communicates with the vent opening in the wall of the canal section for obtaining a desired length of the vent, e.g. equal to the sum of the length of the tube and the thickness of the wall. The length and diameter of the tube may be designed to obtain a desired low frequency gain. Although the vent with the tube will be longer than the thickness of the wall, it will remain shorter than the longitudinal extension of the canal section thereby maintaining a low occlusion level.

Preferably, the canal section is substantially empty leaving as much space available for the vent as possible, i.e. maximising the cross-section of the vent to minimize the occlusion effect. A few components may be located inside the canal section provided that sufficient space remains available for the vent to significantly reduce the occlusion effect. Such components may include, but is not limited to, a receiver for conversion of an electronic signal into sound, a sound tube, a cerumen filter, etc.

Preferably, the outer ear section does not obstruct the ear canal where it opens to the outer ear so that the venting effect provided by the canal section remains effective.

The outer ear section provides space for electronic components of the hearing device. These components may include, but is not limited to, one or more microphones, amplifiers, batteries, control circuits, electrical contacts and connectors, etc.

In one embodiment, the outer ear section and the canal section form an integral housing that is manufactured in one piece.

In another embodiment, the outer ear section and the canal section are manufactured as separate parts that are interconnected mechanically and possibly electrically during production of the hearing device.

Sound signals may propagate as acoustic signal from a receiver positioned in the outer ear section of the hearing device and through a sound tube to an output port at the end of the canal section for transmission of the sound to the eardrum in the ear canal.

Sound signals may alternatively propagate as electrical signals from the output of a signal processor in the outer ear section and through the sound tube to a receiver in the canal section that is positioned for emission of sound through the output port of the canal section.

In one embodiment, the canal section and the outer ear section are mechanically interconnected by the sound tube. The interconnecting sound tube has a small cross-section causing minimum obstruction of the ear canal so that insertion of the sound tube in the ear canal substantially does not diminish the venting effect provided by the canal section.

Further, provision of sound tubes in different standard lengths makes it possible to assemble hearing aids according to the invention that is adapted for the specific insertion depth of the canal section into the ear canal of the user.

A hearing aid that is composed by a standard sized housing, a standard sized sound tube, and a standard sized earpiece, which standard sized components may be manufactured in a number of sizes and forms, makes it possible to assemble a hearing aid that that is adapted for the individual user, while at the same time avoiding the drawbacks of custom made hearing aids, such as the lengthy and costly manufacturing procedure of custom made earpieces. By supplying a dispenser with components (housing, earpieces and sound tubes) of various standard sizes and forms it will be possible for the dispenser to readily select those components that are best suited for each individual user. Typically, each component need only be produced in a few standard sizes in order to be able to assemble a hearing aid for almost any user.

Provision of sound tubes with different diameters makes it possible to adjust the resulting venting or openness of the assembled hearing aid by selecting a sound tube diameter causing the required degree of obstruction of the ear canal of the user.

In one embodiment of the invention, the hearing device housing further comprises a helix section that is adapted to be positioned in the helix of the ear of the wearer and that is mechanically interconnected with the outer ear section via a bridge section. The helix section, the bridge section and the outer ear section preferably form an integral unit that is manufactured in one piece. Positioning of the microphone(s) of the hearing device in the helix section creates a large distance between the microphone(s) and the receiver thereby minimizing feedback. Further, the helix section assists in retaining the housing in the ear of the wearer. The helix section and the bridge section may also accommodate hearing device components.

The housing according to the present invention is manufactured in a number of standard sizes to fit the human anatomy of the ear of most users whereby the manufacturing cost is lowered.

In a preferred embodiment of the invention, an earpiece for insertion into the ear canal of the user constitutes the canal section.

Preferably, the earpiece is flexible for comfortable accommodation of the earpiece in the ear canal of the user providing a high level of comfort. The flexible earpiece remains securely in place in the ear canal without falling out of the ear irrespective of movements of the wearer, such as chewing or yawning, without causing pain to the wearer, and due to the short vent acoustical feedback generating unpleasant and annoying whistling or howling is also avoided.

The earpiece and the outer ear section may be interconnected with a substantially rigid sound tube for transmission of sound from a receiver in the outer ear section to the output port of the earpiece. The substantially rigid sound tube is flexible in a direction perpendicular to the longitudinal extension of the tube; however, the tube is substantially rigid, i.e. substantially not flexible (compressible or extendable), along its longitudinal direction thereby providing capability of retention of the earpiece in the ear canal of the wearer. During positioning of the outer ear section in its intended position at the outer ear in front of the user's pinna during use, the transverse flexibility of the tube facilitates insertion of the earpiece into the ear canal of the user.

Further, for embodiments with an outer ear section that is retained within or at the outer ear after positioning in its intended position, the rigidity of the tube along its longitudinal extension will further prevent the earpiece from falling out of the ear canal.

Thus, in a preferred embodiment of the invention, a flexible earpiece for positioning in the ear canal of a user is provided that comprises a base, and at least one sidewall that is attached to the base and has an edge that extends substantially from the base to an opening of the earpiece. The width of the opening may fit within the ear canal of the user.

The base constitutes the bottom of the earpiece, i.e. the part of the earpiece that is supposed to be positioned deepest in the ear canal when a user wears the earpiece. The base is sufficiently rigid and thick to carry and support the attached sidewall without being deformed. The sidewall is made from a thin sheet of a soft and flexible material and it functions to hold the earpiece in an intended position within the ear canal of the user. In this position, the base does not touch the ear canal. The edge of the sidewall allows the sidewall to adjust to the size and shape of the user's ear canal as the edge may move along the surface of the ear canal when the earpiece is being inserted and pressure thereby is applied to the sidewall by the ear canal. The circumferential displacement of the edge allows the sidewall to adjust to the shape and size of the user's ear canal without wrinkling and loosing contact with the ear canal so that undesirable leaks do not occur.

Preferably, the earpiece has a first sidewall and a second sidewall, each of which has an edge that extends from adjacent parts of the base to the opening. This arrangement of the sidewalls and their respective edges allows the edges to move in the direction of the circumference of the earpiece in opposite directions during insertion into or removal from the ear canal.

In a preferred embodiment, the sidewalls are mutually overlapping. In this case, the edge of the first sidewall is covered by the second sidewall whereby only one of the edges is in direct contact with the skin of the ear canal when the earpiece is in use. This reduces the risk of undesired openings or leaks in the earpiece along the edges of the sidewalls.

Preferably, the sidewall of the earpiece has a generally conical shape. Thus, the insertion depth of the earpiece in a wearer's ear canal may be chosen to correspond to the size of the specific ear canal, which should be somewhere in between the smallest and largest cross sections of the conical sidewall. Thereby, the earpiece may fit into a wide range of sizes of ear canals.

The conical shape may have a substantially elliptical cross-section. This is advantageous, as most ear canals are, more or less, oval or elliptical in shape. Thus, the earpiece will fit well and will also be easier for the user to insert in an optimal position in the ear canal.

Preferably, the first sidewall is thickest along the edge of the first sidewall, while the second sidewall is thinnest along the edge of the second sidewall. Thus, the first sidewall will be more rigid along its edge, while the second sidewall will be softer or more flexible along the edge. If the edge of the second sidewall is positioned between the ear canal and the first sidewall, then the rigidness of the first sidewall will provide an outward pressure on the second sidewall in the direction of the ear canal surface. The flexibility of the second sidewall therefore assures close contact between itself and both of the first sidewall and the surface of the ear canal. Thereby, undesired leaks are prevented along the edges of the sidewalls as well as a close and tight fit in the ear canal.

The thinnest parts of the sidewalls are preferably about half the thickness of the thickest parts. The thinnest part may have a thickness in the range of 0.05 mm to 0.5 mm, such as in the range of 0.1 mm to 0.45 mm, such as in the range of 0.15 mm to 0.4 mm, such as in the range of 0.2 mm to 0.35 mm, such as in the range of 0.25 mm to 0.3 mm. Accordingly, the thickest part may have a thickness in the range of 0.1 mm to 1.0 mm, such as in the range of 0.2 mm to 0.9 mm, such as in the range of 0.3 mm to 0.8 mm, such as in the range of 0.4 mm to 0.7 mm, such as in the range of 0.5 mm to 0.6 mm.

The base of the earpiece preferably comprises an output port, e.g. an opening, for emission of sound into the ear canal of the user.

A sound tube may be attached to a connector for communication with the output port. The sound tube transmits sound output from the receiver of the hearing device and emits it into the ear canal through the output port.

Furthermore, the base may comprise a vent. When the earpiece is inserted into the user's ear canal, the vent provides communication between the ear canal behind the base of the earpiece and the surroundings. The vent opening may be a hole in the base having a substantially circular or elliptical shape. Thereby, occlusion is prevented and the user may furthermore be able to receive sound bypassing the hearing device processing, i.e. natural sound. The latter is often desirable e.g. in headsets, headphones, or hearing aids when the user has a limited hearing impairment, such as in the high frequency range. In this case, the user may hear low frequency sounds very well and therefore does not need the hearing device to process these signals.

Often, it is not desirable that the user receives the same sound both naturally through the vent and processed by the hearing device. This may be the case e.g. when the hearing device processing causes an audible delay between the natural and processed sound. To avoid this, the vent opening may be connected to an acoustic filter extending from the base. The acoustic filter may be a low-pass filter, a band-pass filter or a high-pass filter designed to fit a group of typical frequency dependent hearing losses in the sense that sound which the user will be able to hear naturally is transmitted by the filter, while sound in the frequency range that is subject to hearing impairment will not be transmitted by the filter. Thereby, the user will hear either natural or processed sound instead of a possibly distorted mixture of these.

Preferably, the base comprises a recess extending substantially across the base. The recess may act as a hinge since it divides the base into two parts allowing the base to bend along the recess when pressure is applied to the sidewall(s) of the earpiece. Thereby, deformation of the base is controlled along the recess. Hereby, deformation of a vent is prevented when the base is subjected to stress during use of the earpiece.

The earpiece is preferably moulded as an integral unit. A highly suitable material is silicone.

Retention of the device in the proper place is important. Jaw movements during chewing for instance can exert outward forces on the canal portion of the device. In certain embodiments on the invention the shape and placement of the housing in or partly in the outer ear will counteract this force sufficiently. In other embodiments or certain ear anatomy this may not be the case wherefore other means for retention may have to be applied. Such means could be a pliable or resilient plastic strip or fibre extending from the housing into a part of the ear that secures the device from outward motion. For example, a resilient fibre may be connected to the canal section for abutting a surface of the outer ear when the canal section has been inserted in the ear canal thereby providing retention of the canal section in the ear canal of the user. Such a strip or fibre could be designed as an accessory to be applied when needed or be integral with the housing. Alternatively, an adhesive pad may be provided on the housing attaching the device to the concha bowl.

In a preferred embodiment of the invention, feedback compensation is provided. Feedback is a well-known problem in hearing aids and several systems for suppression and cancellation of feedback exist within the art. With the development of very small digital signal processing (DSP) units, it has become possible to perform advanced algorithms for feedback suppression in a tiny device such as a hearing aid, see e.g. U.S. Pat. No. 5,619,580, U.S. Pat. No. 5,680,467 and U.S. Pat. No. 6,498,858.

The above mentioned prior art systems for feedback cancellation in hearing aids deal with external feedback, i.e. transmission of sound between the loudspeaker (often denoted receiver) and the microphone of the hearing aid along a path outside the hearing aid device. This problem, which is also known as acoustical feedback, occurs e.g. when a hearing aid earpiece does not completely fit the wearer's ear, or in the case of an earpiece comprising a vent. In both examples, sound may "leak" from the receiver to the microphone and thereby cause feedback.

The problem of external feedback limits the maximum gain available in a hearing aid.

Thus, the hearing instrument may further comprise a feedback compensation circuit for providing a feedback compensation signal of signals picked up by the microphone by modelling an acoustical and mechanical feedback signal path of the hearing aid, subtracting means for subtracting the feedback compensation signals from the audio signal to form a compensated audio signal, which is input to the signal processor of the hearing instrument.

The feedback signal path is typically an acoustic path between the microphone and the receiver, i.e. an external feedback signal propagates through air surrounding the hearing aid.

Preferably, the feedback compensation means comprises an adaptive filter, i.e. a filter that changes its impulse response in accordance with changes in the feedback path.

Both static and adaptive filters are well known to a person skilled in the art of hearing aids, and will therefore not be discussed in further detail here.

The invention will now be described in further detail with reference to the accompanying drawings.

Below, the invention will be further described and illustrated with reference to the accompanying drawings in which:

FIG. 1 shows a first embodiment of the invention from two different angles,

FIG. 2 shows a second embodiment corresponding to the embodiment of FIG. 1 with a different earpiece, FIG. 3 shows the first embodiment positioned in the ear of a user, FIG. 4 shows an embodiment of an earpiece according to the invention, FIG. 5 shows the earpiece of FIG. 4 from a different angle, FIG. 6 shows another embodiment of an earpiece according to the invention, FIG. 7 shows a third embodiment of the invention from two different angles, FIG. 8 shows the third embodiment positioned in the ear of a user, FIG. 9 shows a fourth embodiment of the invention from two different angles, FIG. 10 shows the fourth embodiment positioned in the ear of a user, FIG. 11 shows a fifth embodiment of the invention, FIG. 12 shows the fifth embodiment positioned in the ear of a user, FIG. 13 shows a sixth embodiment of the invention, and FIG. 14 shows the sixth embodiment positioned in the ear of a user.

Figure 1:
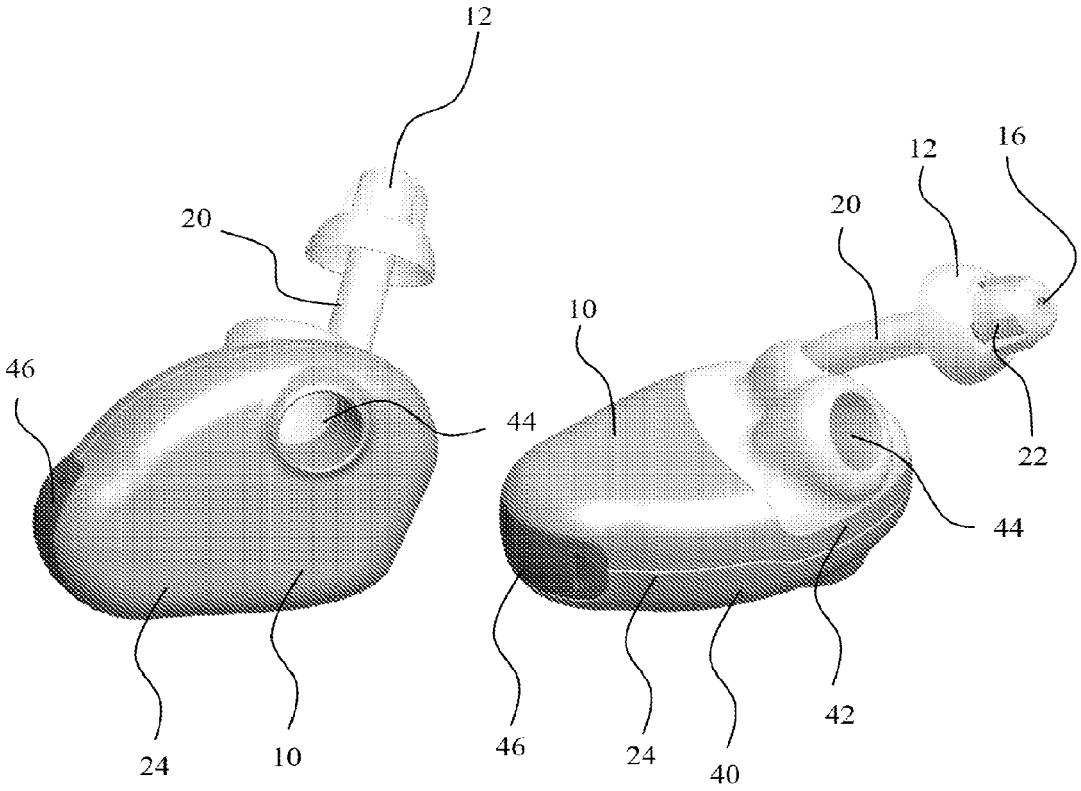

FIG. 1 shows in perspective from two different angles, a hearing device according to a first embodiment of the present invention, having a housing 10 with a canal section in the form of a dome-shaped earpiece 12 that is adapted to be positioned in the ear canal 14 of a wearer comfortably fitting the ear canal 14 for retention of the earpiece 12 in the ear of the wearer. The earpiece 12 has an output port 16 for emission of sound towards the eardrum of the wearer. The earpiece 12 further has vents 22 that allow sounds outside and within the ear to pass through the ear canal through the earpiece 12 thereby substantially eliminating the occlusion effect when the earpiece 12 is inserted into the ear canal of the wearer.

The earpiece 12 material may be a soft elastomer, such as silicone rubber or other soft plastic. The earpiece 12 material preferably has a durometer of about 30 Shore A.

The housing 10 further comprises an outer ear section 24 that is connected to the earpiece 12 for accommodation of hearing device components and adapted for positioning at the concha 26 of the ear during use. The outer ear section 24 is manufactured in two parts 40, 42 and has an opening 44 extending through the outer ear section 24 facilitating communication between the ear canal and the surroundings of the wearer. A battery lid 46 is provided at an end of the outer ear section 24. The battery lid 46 has a compartment accommodating the battery. The battery compartment swings out of the outer ear section 24 when the battery lid is opened whereby the battery may be exchanged with a new battery.

The outer ear section 24 and the earpiece 12 are interconnected with a substantially rigid sound tube 20. The sound tube 20 provides a sound propagation path for sound signals emitted by a receiver 100 (FIG. 2) positioned in the outer ear section 24 of the hearing device 10 to the output port 16 at the end of the earpiece 12 for transmission of the sound to the eardrum (not shown) in the ear canal 14. The sound tube 20 is flexible in a direction perpendicular to the longitudinal extension of the tube 20; however, the tube 20 is substantially rigid, i.e. substantially not flexible (compressible or extendable), along its longitudinal direction thereby providing retention of the earpiece 12 in the ear canal 14 of the wearer. During positioning of the outer ear section 24 at the concha 26 of the ear for retention of the outer ear section in the outer ear behind the tragus 13 and the anti-tragus 15, the transverse flexibility of the tube 20 facilitates insertion of the earpiece 12 in the ear canal 14 and the rigidity of the tube 20 along its longitudinal extension will prevent the earpiece 12 from falling out of the ear canal 14 when the outer ear section is positioned at the concha as shown in FIG. 3.

As clearly seen in FIG. 1, the vent 22 is very short, namely equal to the thickness of the wall of the earpiece 12 and has a large cross-section whereby the occlusion effect is substantially eliminated.

The outer ear section 24 accommodates the microphone(s) 102 (FIG. 2), and other hearing device components (not shown), such as amplifier, battery, controls, electrical contacts and connectors, etc.

In some embodiments, the hearing instrument may further comprise a feedback compensation circuit 106 (FIG. 2) for providing a feedback compensation signal of signals picked up by the microphone by modelling an acoustical and mechanical feedback signal path of the hearing aid, subtracting means for subtracting the feedback compensation signals from the audio signal to form a compensated audio signal, which is input to the signal processor 108 (FIG. 2) of the hearing instrument. Also, in some embodiments, the hearing instrument may optionally include a resilient fibre (element 110 in FIG. 2, or element 32 in FIG. 7). The resilient fibre 32/110 may be connected to the open canal section for abutting a surface of the outer ear when the open canal section has been inserted in the ear canal thereby providing retention of the open canal section in the ear canal of the user. Such a strip or fibre 32/110 could be designed as an accessory to be applied when needed or be integral with the housing. Alternatively, an adhesive pad may be provided on the housing attaching the device to the concha bowl.

Figure 2:
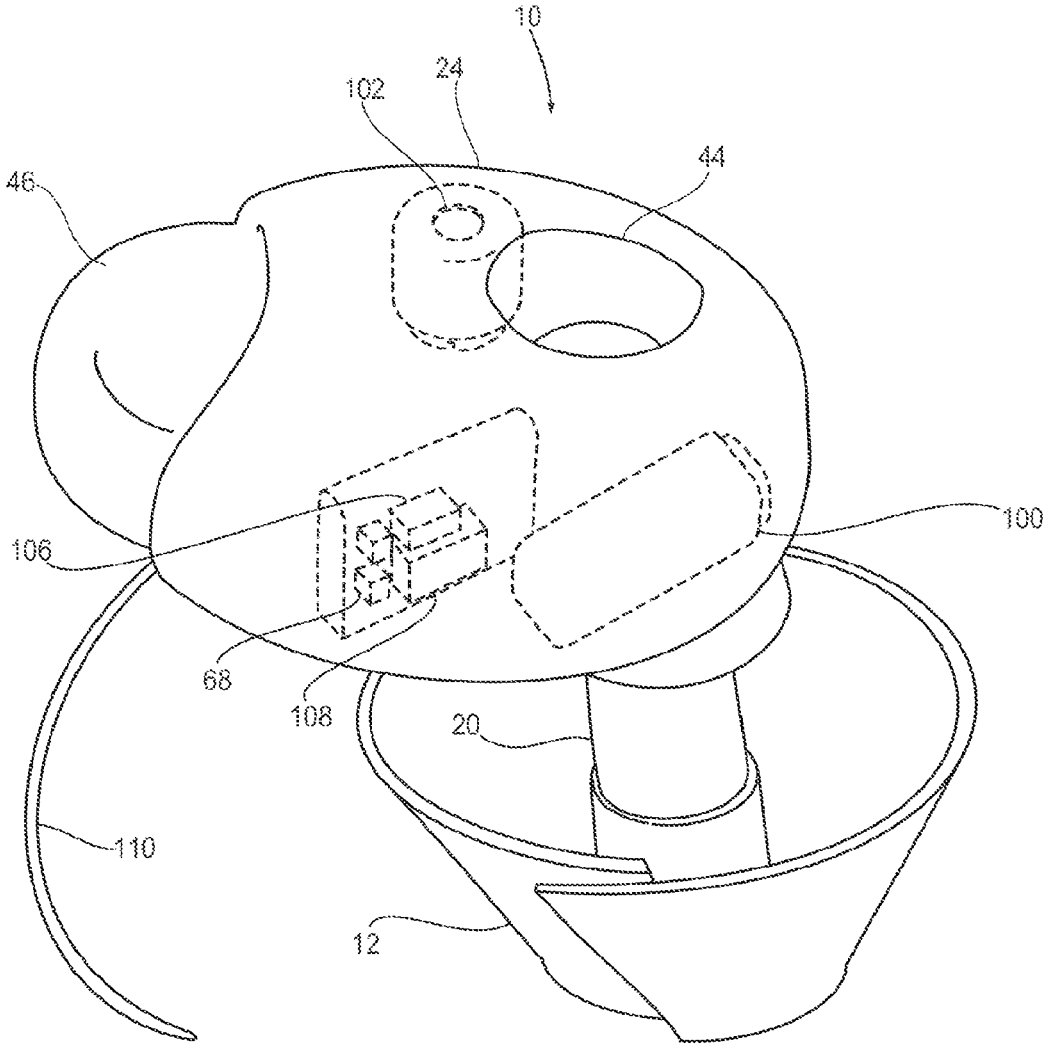
Figure 3:
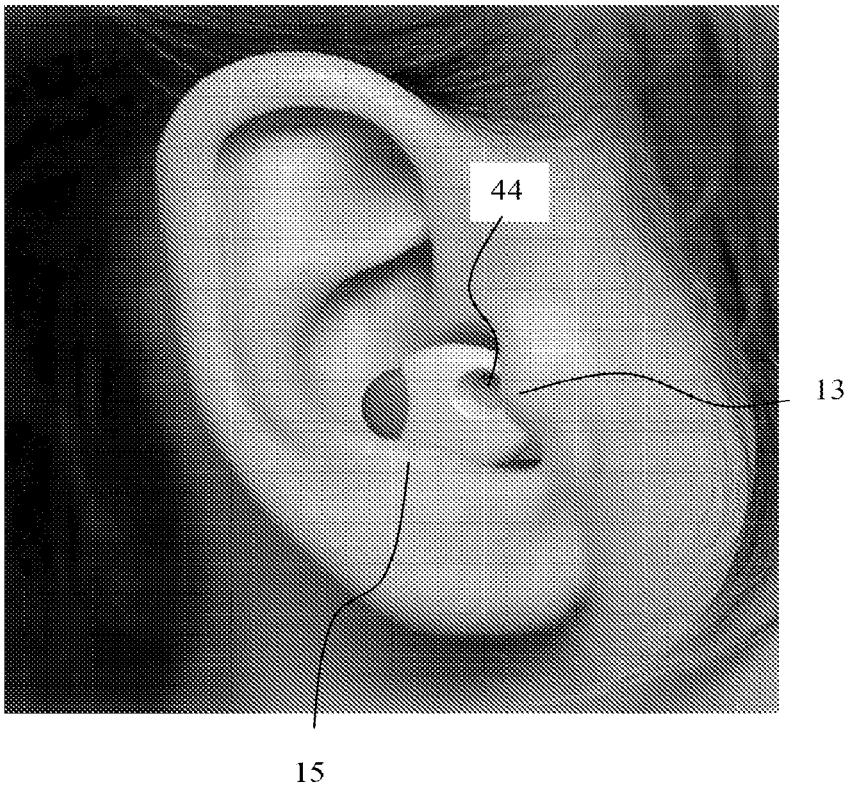
Figure 4:
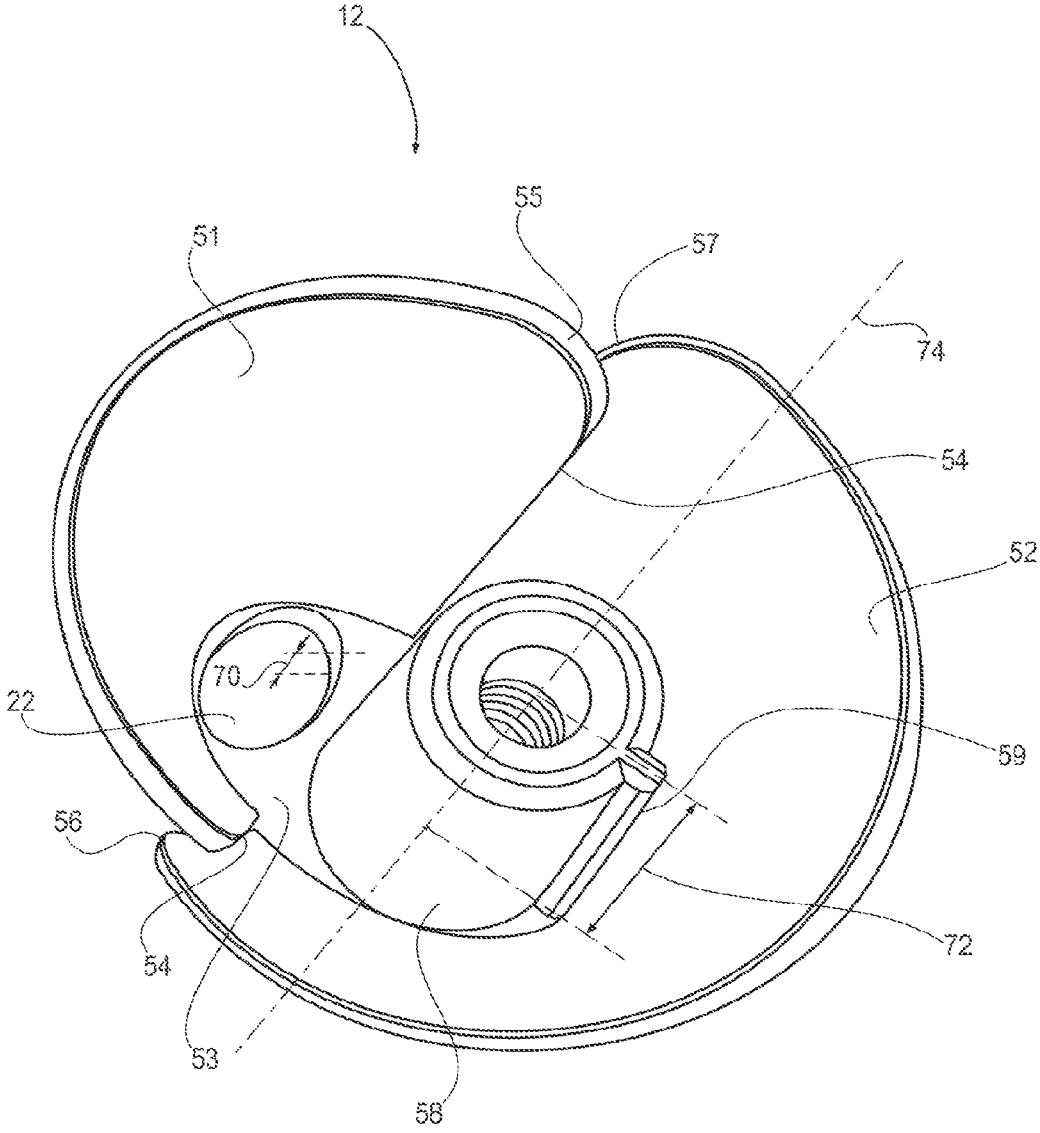
Figure 5:
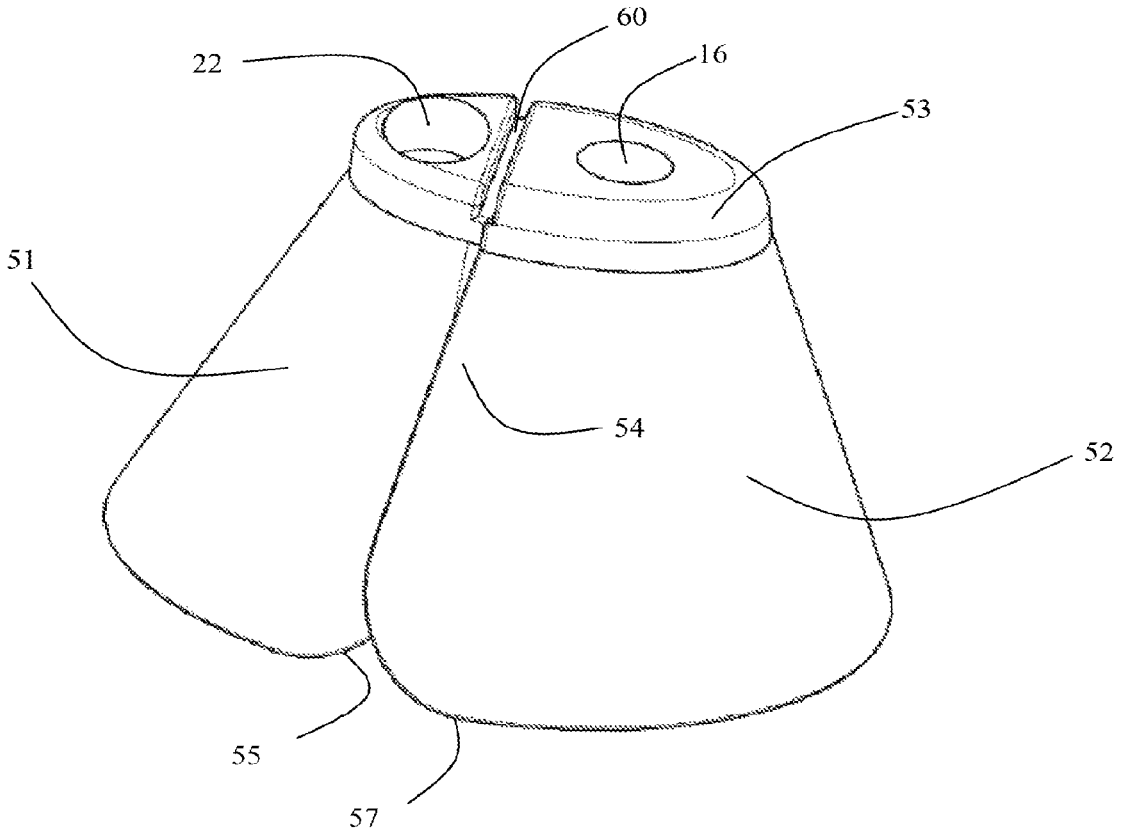
Figure 6:
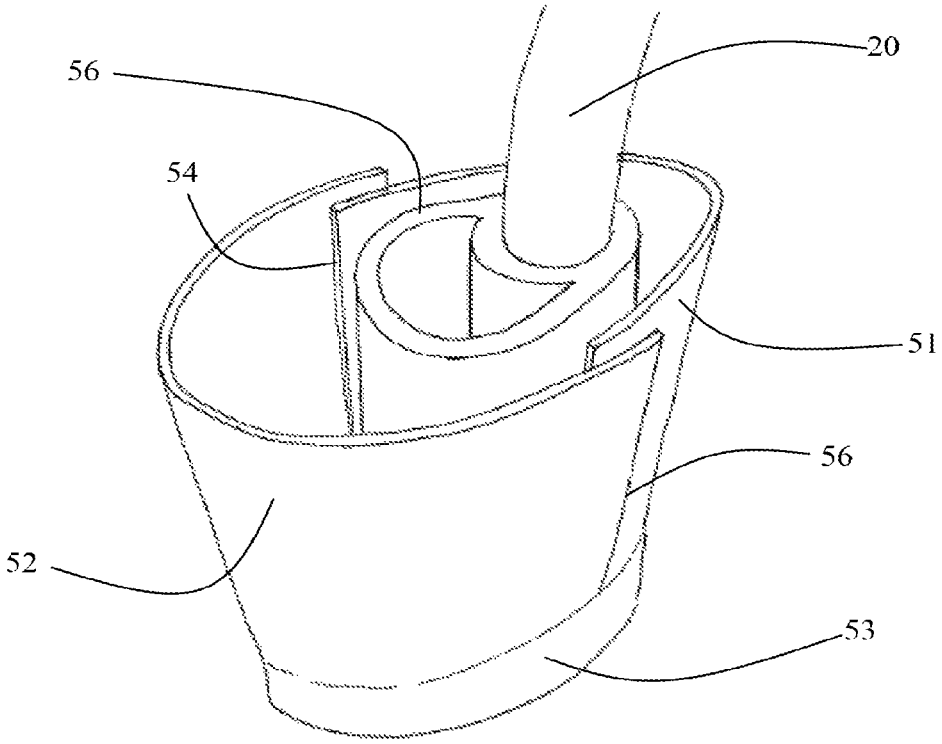
Figure 15:
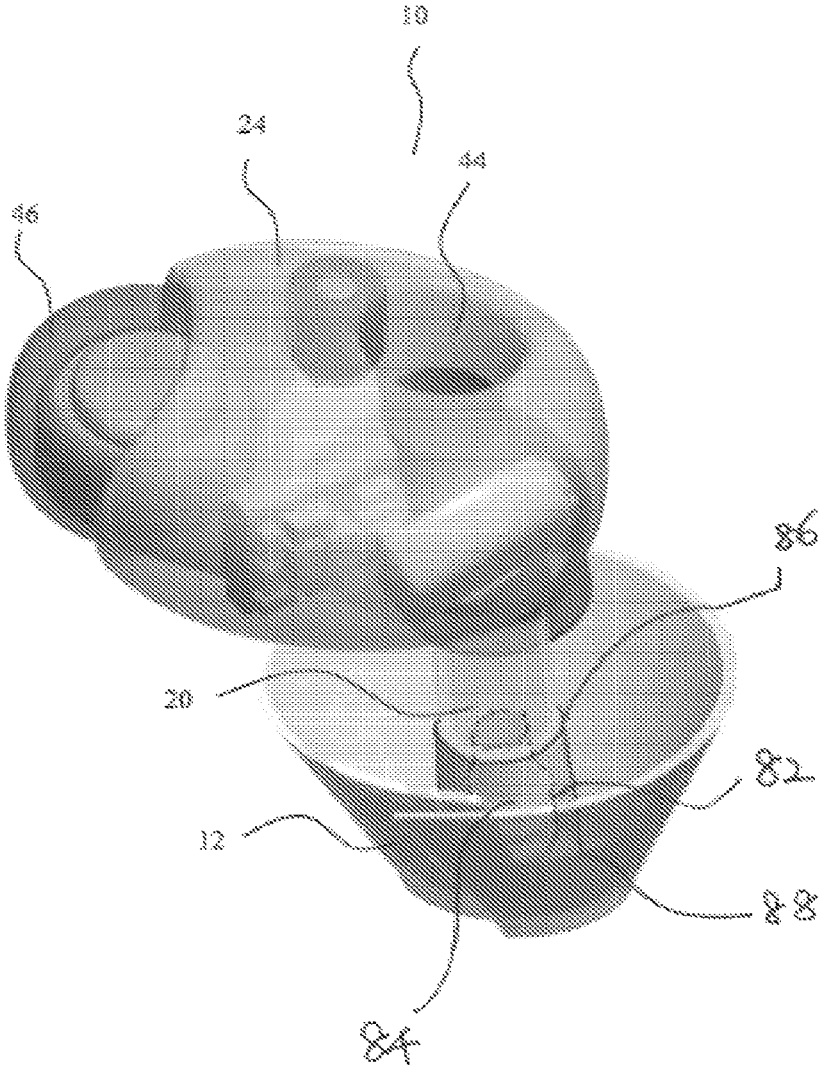
FIG. 15 shows another embodiment of a hearing aid.
Figure 16:
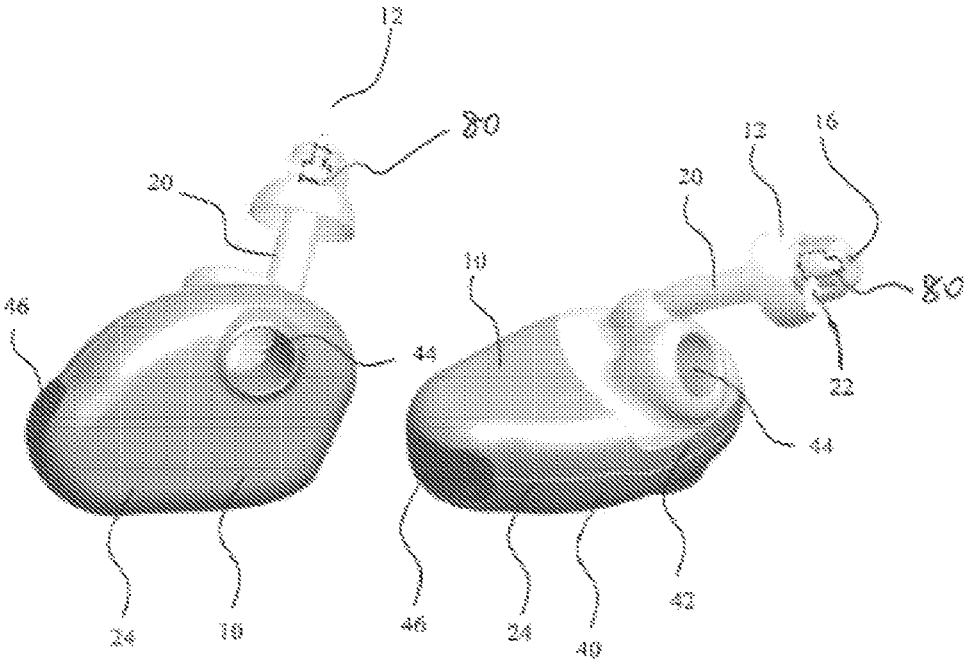
FIG. 16 shows another embodiment of a hearing aid.

FIG. 2 shows a second embodiment similar to the embodiment shown in FIG. 1, however, with a different earpiece 12 shown in more detail in FIGS. 4-6. The illustrated second embodiment includes a substantially rigid sound tube 20 identical to the sound tube described in relation to FIG. 1. The earpiece 12 having a tubular member 82 with a first end 88, a second end 86, and a lumen 84 extending from the second end 86 for accommodating a portion of the sound tube 20 (see FIG. 15).

FIGS. 4-6 show the earpiece 12 of the embodiment shown in FIG. 2 in more detail. This earpiece 12 has two sidewalls 51, 52 extending from a base 53. The sidewall 51 has edges 54 and is somewhat smaller, i.e. the sidewall 51 extends along a shorter part of the circumference of the base, than sidewall 52, which has edges 56. Together, the sidewalls 51, 52 form a conical sidewall. The smaller sidewall 51 is positioned so that its edges 54 may move relative to the edges 56 within the larger sidewall 52 when pressure is applied to (or released from) the sidewalls when the earpiece 12 is accommodated in a user's ear canal. Both sidewalls 51, 52 have rounded transition sections 55, 57 between the edges 54, 56 and the outer rim of the sidewalls 51, 52. This reduces the risk of collision between the edges 54, 56 in comparison to e.g. sidewalls with simple sharp corners. A sound tube connector 58 may be provided on the base 53 above the output port (not shown) in the base 53 through which sound provided by a sound tube (not shown) may be injected into the ear canal of the user. A protrusion 59 may be provided on the side of the connector 58 fitting a corresponding recess in the sound tube whereby the sound tube may be connected to the earpiece in a predetermined angular orientation. Finally, a vent 22 is provided in the base 53.

It should be noted that the outer sidewall 52 is thinner than the inner sidewall 51 in the regions close to the respective edges 56 and 54. Therefore, the outer wall will tend to be softer and more flexible in the vicinity of the edges 56 than the inner wall in the corresponding regions. Thus, when the earpiece 12 is inserted into a user's ear canal, the rigidness of the inner sidewall 51 will provide an outward pressure on the overlapping part of the outer sidewall 52 in the direction of the ear canal surface. The flexibility of the outer sidewall 52 at the same time provides close contact between itself and both of the inner sidewall 51 and the surface of the ear canal. Thereby, undesired leaks are prevented along the edges 54, 56 of the sidewalls 51, 52 and a close and tight fit in the ear canal is provided.

Furthermore, the inner wall 51 is thinnest, and therefore most flexible, in the part about midway between the edges 54. This further enhances the above effect, that the inner wall 51 will provide a pressure on the overlapping part of the outer wall 52. Analogously, the outer wall 52 has its thickest section about halfway between its edges 56.

The thinnest parts of the sidewalls 51, 52 are preferably about half the thickness of the thickest parts. The thinnest parts may thus have a thickness in the range of 0.05 mm to 0.5 mm, such as in the range of 0.1 mm to 0.45 mm, such as in the range of 0.15 mm to 0.4 mm, such as in the range of 0.2 mm to 0.35 mm, such as in the range of 0.25 mm to 0.3 mm. Accordingly, the thickest parts may have a thickness in the range of 0.1 mm to 1.0 mm, such as in the range of 0.2 mm to 0.9 mm, such as in the range of 0.3 mm to 0.8 mm, such as in the range of 0.4 mm to 0.7 mm, such as in the range of 0.5 mm to 0.6 mm.

Further, FIG. 5 shows a recess 60 provided in the outward facing surface of the base 53. This recess 60 extends across the oval base 53, thus dividing the base 53 into two sections, one containing the vent 22, and another containing the output port 16 for emission of sound into the user's ear canal. The recess 60 functions as a hinge, so that a force that is exerted upon the sidewalls 51, 52 will cause the two sections of the base 53 to bend along the recess 60. Thereby, the base 53 is exposed to less stress, and deformation of the vent opening 22 is avoided.

When the earpiece is inserted into a user's ear canal, pressure is applied to the sidewalls. This will cause the edges to move so that the overlap increases and the circumference of the sidewall decreases correspondingly. The pressure applied to the sidewall by the user's ear canal will provide close contact between the overlapping parts of the sidewalls so that no leaks occur along the edges of the sidewall. The illustrated earpiece fits a large number of users while providing a high level of comfort.

FIG. 6 shows an exemplary embodiment of the invention, wherein a vent 22 is provided as a short tube 56 parallel to and integral with a sound tube connector for receiving and holding the sound tube 20. Depending on the length and cross-sectional shape of the venting tube 56, this vent 22, 56 may function as an acoustic filter, such as a low pass filter.

It has surprisingly been found that the earpieces illustrated in FIGS. 4-6 may provide venting even without a vent 22 in the base 53. This is believed to be due to the walls 51, 52, at least at the edges 54, 56, being sufficiently thin to be transparent to sound so that sound propagates through the earpiece in the ear canal substantially without attenuation whereby the user does not experience the occlusion effect.

Figure 7:
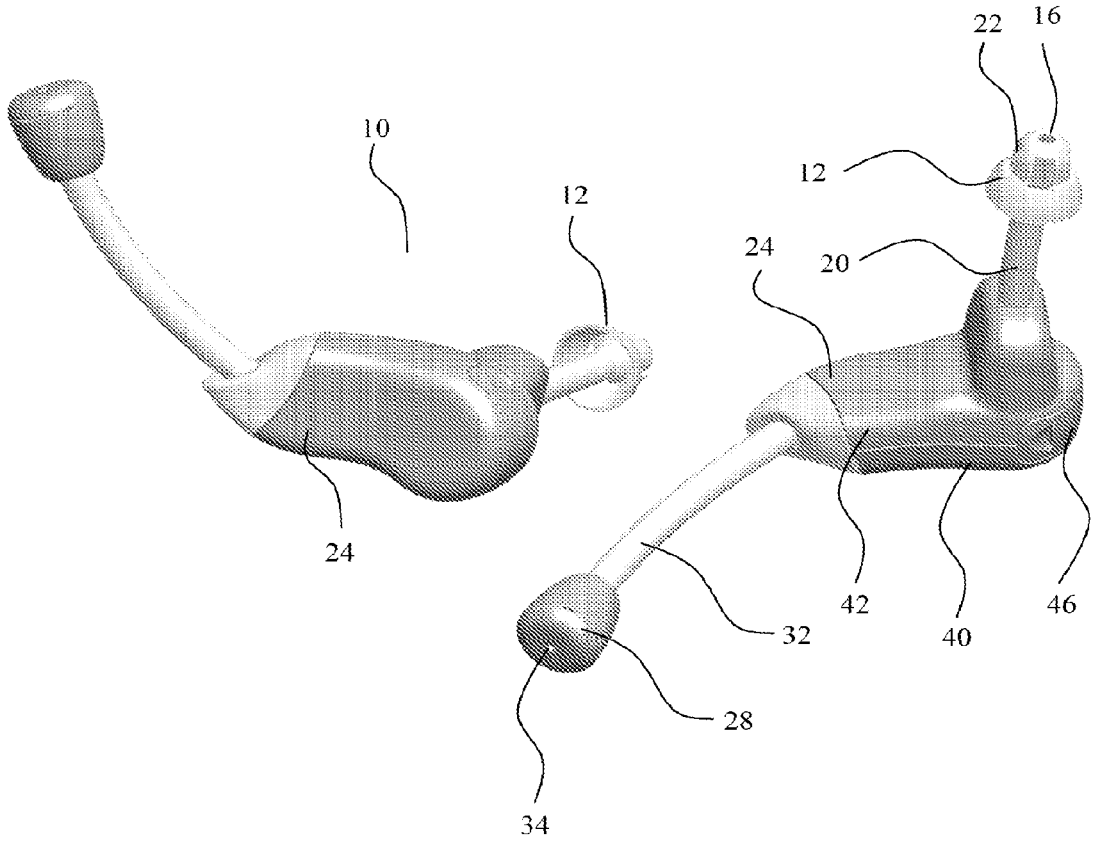
Figure 9:
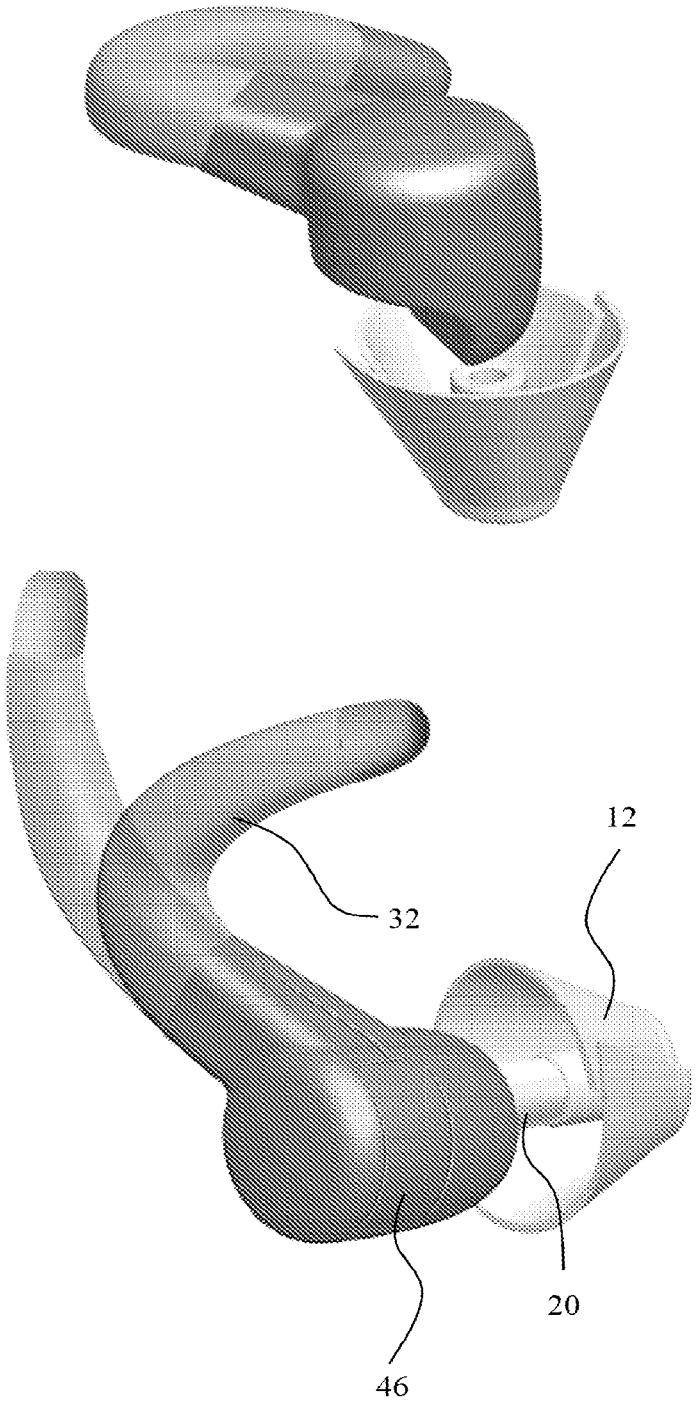

FIGS. 7 and 9 show in perspective from two different angles, a hearing device according to a third and a fourth embodiment, respectively, of the present invention, having a housing 10 with a canal section in the form of a dome-shaped earpiece 12 that is adapted to be positioned in the ear canal 14 of a wearer comfortably fitting the ear canal 14 for retention of the earpiece 12 in the ear of the wearer. The earpiece 12 has an output port 16 for emission of sound towards the eardrum of the wearer. The earpiece 12 further has vents 22 that allow sounds outside and within the ear to pass through the ear canal through the earpiece 12 thereby substantially eliminating the occlusion effect when the earpiece 12 is inserted into the ear canal of the wearer.

Figure 8:
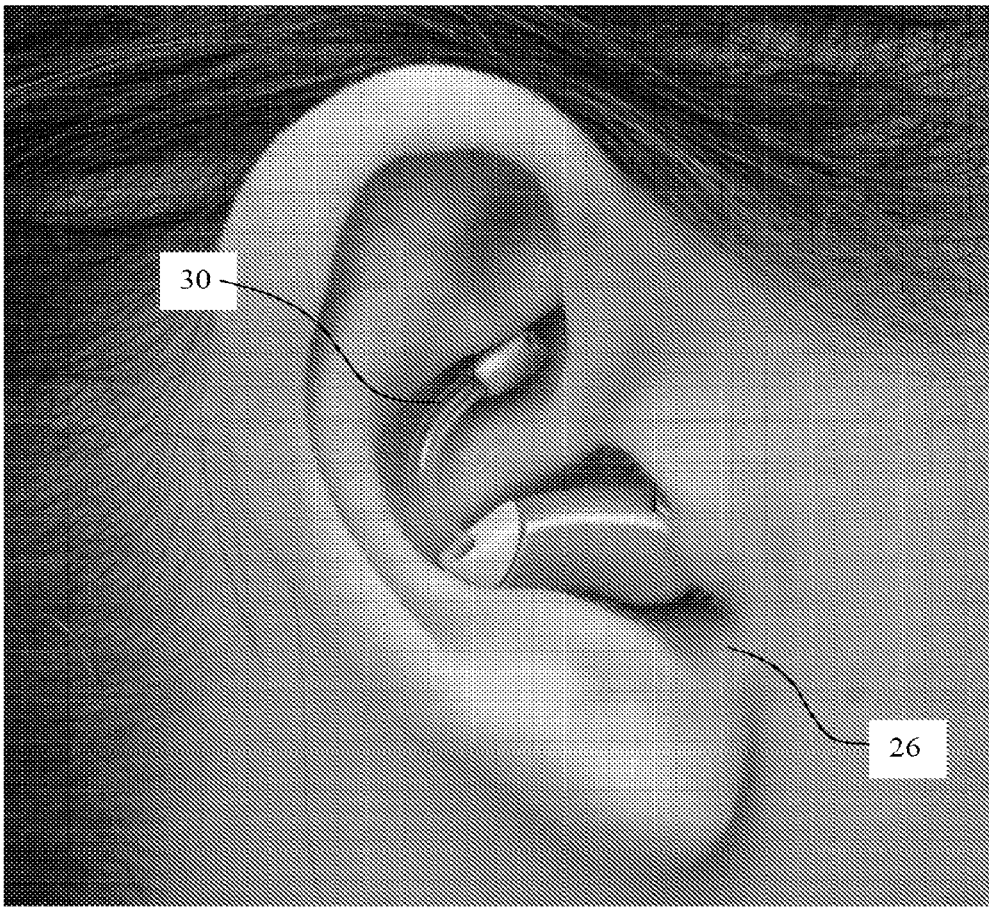
Figure 10:
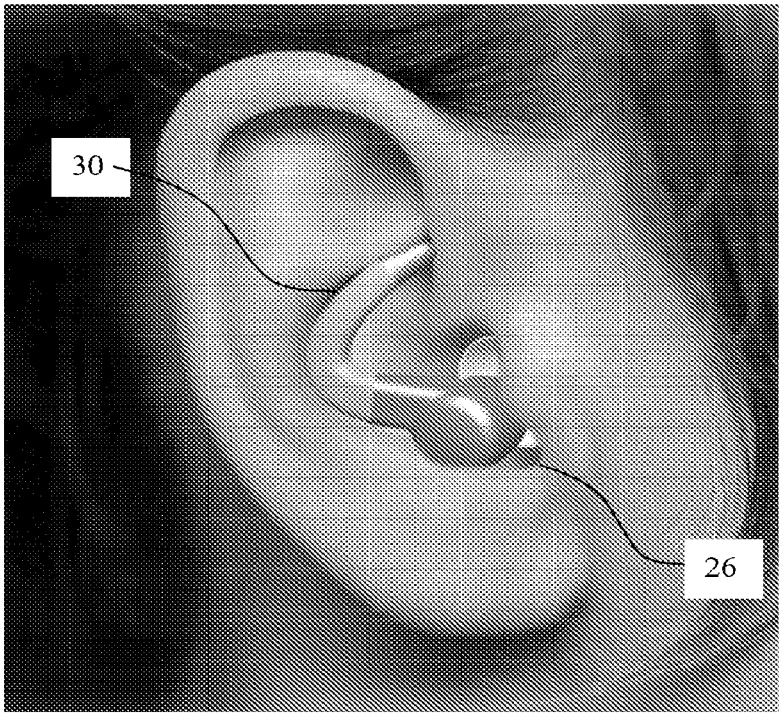

The housing 10 further comprises an outer ear section 24 that is connected to the earpiece 12 for accommodation of hearing device components and adapted for positioning at the concha 26 of the ear during use as shown in FIGS. 8 and 10, respectively. The outer ear section 24 further comprises a helix section 28 that is adapted to be positioned in the helix 30 of the ear of the wearer and that is mechanically interconnected with the outer ear section 24 with a bridge section 32. In the illustrated embodiment, the helix section 28, the bridge section 32 and the outer ear section 24 form separate units that are manufactured in separate pieces. Positioning of the microphone(s) 102 (FIG. 7) at the microphone input port 34 of the hearing device in the helix section 28 creates a large distance between the microphone(s) and the receiver thereby minimizing feedback. Further, the helix section 28 assists in retaining the housing 10 in the ear of the wearer. The helix section 28 and the bridge section 32 may also accommodate hearing device components.

Positioning of the microphone(s) of the hearing device in the helix section 28 creates an increased distance between the microphone(s) and the output port 16 as compared to the corresponding distance in conventional ITE and CIC hearing aid devices whereby feedback is diminished.

The outer ear section 24 is manufactured in two parts 40, 42. A battery lid 46 is provided at an end of the outer ear section 24. The battery lid 46 has a compartment accommodating the battery. The battery compartment swings out of the outer ear section 24 when the battery lid is opened whereby the battery may be exchanged with a new battery.

The outer ear section 24 and the earpiece 12 are interconnected with a substantially rigid sound tube 20. The sound tube 20 provides a sound propagation path for sound signals emitted by a receiver (not shown) positioned in the outer ear section 24 of the hearing device 10 to the output port 16 at the end of the earpiece 12 for transmission of the sound to the eardrum (not shown) in the ear canal 14. The sound tube 20 is flexible in a direction perpendicular to the longitudinal extension of the tube 20; however, the tube 20 is substantially rigid, i.e. substantially not flexible (compressible or extendable), along its longitudinal direction thereby providing retention of the earpiece 12 in the ear canal 14 of the wearer. During positioning of the outer ear section 24 at the concha 26 and the helix 30 of the ear, the transverse flexibility of the tube 20 facilitates insertion of the earpiece 12 in the ear canal 14 and the rigidity of the tube 20 along its longitudinal extension will prevent the earpiece 12 from falling out of the ear canal 14 when the outer ear section is positioned at the outer ear in front of the pinna at the concha and helix as shown in FIGS. 8 and 10.

The outer ear section 24 accommodates the hearing device components (not shown), such as the microphone(s), amplifier, battery, controls, electrical contacts and connectors, etc.

Figure 11:
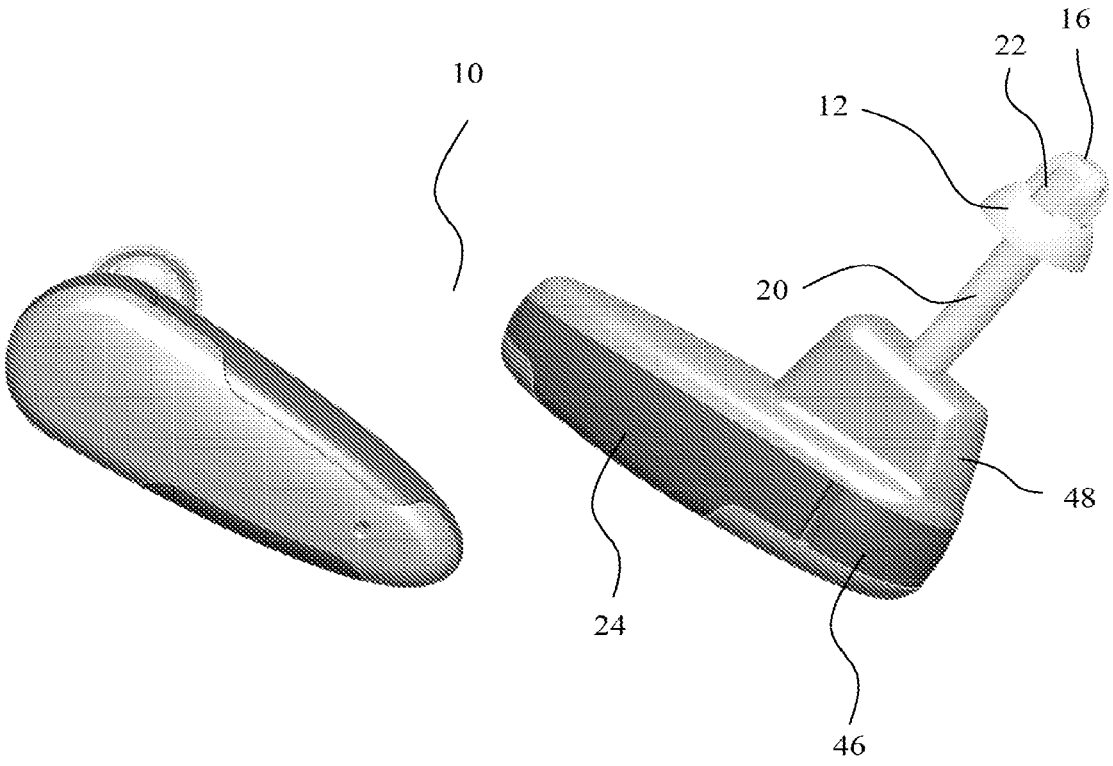

FIG. 11 shows in perspective from two different angles, a hearing device according to a fifth embodiment of the present invention, having a housing 10 with canal a section in the form of a dome-shaped earpiece 12 that is adapted to be positioned in the ear canal 14 of a wearer comfortably fitting the ear canal 14 for retention of the earpiece 12 in the ear of the wearer. The earpiece 12 has an output port 16 for emission of sound towards the eardrum of the wearer. The earpiece 12 further has vents 22 that allow sounds outside and within the ear to pass through the ear canal through the earpiece 12 thereby substantially eliminating the occlusion effect when the earpiece 12 is inserted into the ear canal of the wearer.

The housing 10 further comprises an outer ear section 24 that is connected to the earpiece 12 for accommodation of hearing device components and adapted for positioning at the concha 26 of the ear during use. The outer ear section 24 further has a protrusion 48 that fits in the space between the tragus 13 and anti-tragus 15 of a human ear for retention of the outer earpiece 24.

The outer ear section 24 is manufactured in two parts 40, 42 and has an opening 44 extending through the outer ear section 24 facilitating communication between the ear canal and the surroundings of the wearer. A battery lid 46 is provided at an end of the outer ear section 24. The battery lid 46 has a compartment accommodating the battery. The battery compartment swings out of the outer ear section 24 when the battery lid is opened whereby the battery may be exchanged with a new battery.

Figure 12:
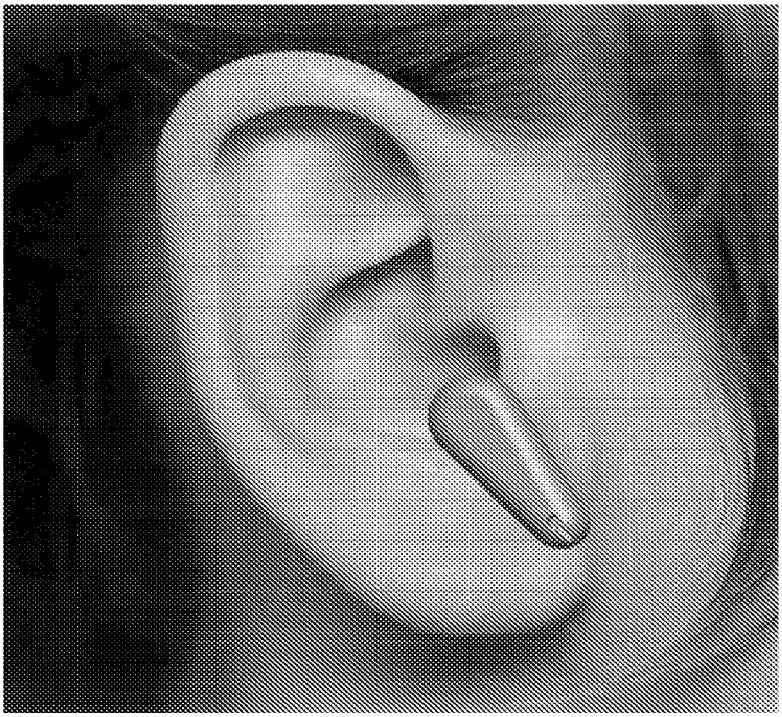

The outer ear section 24 and the earpiece 12 are interconnected with a substantially rigid sound tube 20. The sound tube 20 provides a sound propagation path for sound signals emitted by a receiver (not shown) positioned in the outer ear section 24 of the hearing device 10 to the output port 16 at the end of the earpiece 12 for transmission of the sound to the eardrum (not shown) in the ear canal 14. The sound tube 20 is flexible in a direction perpendicular to the longitudinal extension of the tube 20; however, the tube 20 is substantially rigid, i.e. substantially not flexible (compressible or extendable), along its longitudinal direction thereby providing retention of the earpiece 12 in the ear canal 14 of the wearer. During positioning of the outer ear section 24 at the concha 26 with the protrusion 48 inserted between the tragus 13 and anti-tragus 15 of the ear for retention of the outer ear section 24 in the outer ear, the transverse flexibility of the tube 20 facilitates insertion of the earpiece 12 in the ear canal 14 and the rigidity of the tube 20 along its longitudinal extension will prevent the earpiece 12 from falling out of the ear canal 14 when the outer ear section is positioned at the outer ear in front of the pinna as shown in FIG. 12.

The outer ear section 24 accommodates the hearing device components (not shown), such as the microphone(s), amplifier, battery, controls, electrical contacts and connectors, etc.

The earpiece of the embodiment shown in FIGS. 7 and 11 may be substituted with one of the earpieces of FIGS. 4-6.

Figure 13:
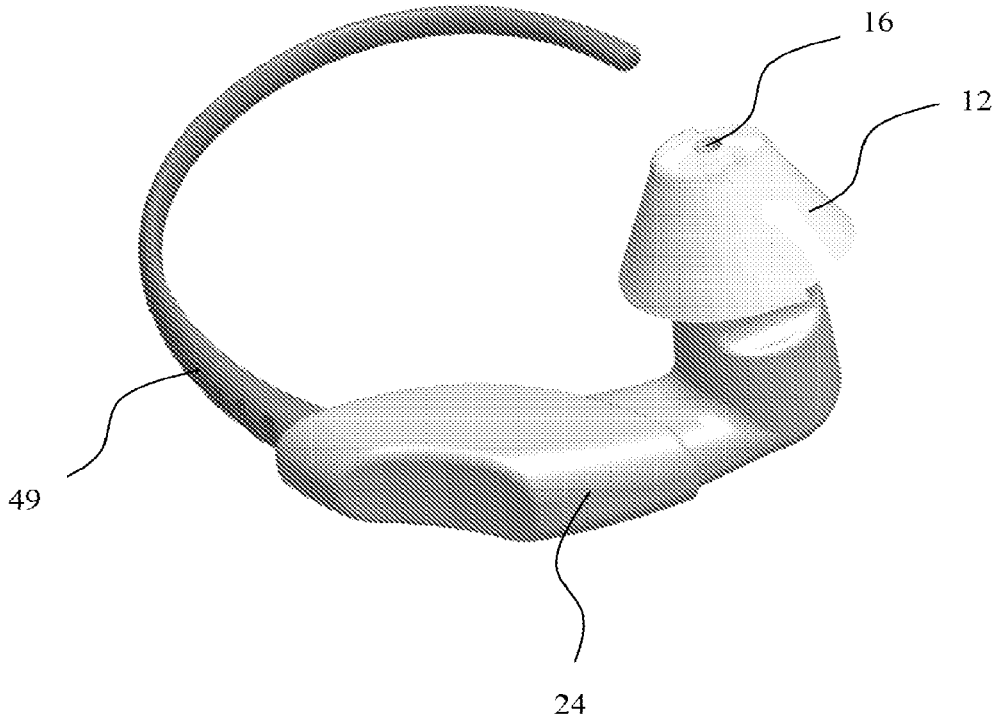

FIG. 13 shows in perspective, a hearing device according to a sixth embodiment of the present invention, having a housing 10 with a canal section shown in FIGS. 4-6 that is adapted to be positioned in the ear canal 14 of a wearer comfortably fitting the ear canal 14 for retention of the earpiece 12 in the ear of the wearer. The earpiece 12 has an output port 16 for emission of sound towards the eardrum of the wearer. The earpiece 12 further has a vent 22 (not shown) that allows sounds outside and within the ear to pass through the ear canal through the earpiece 12 thereby substantially eliminating the occlusion effect when the earpiece 12 is inserted into the ear canal of the wearer.

Figure 14:
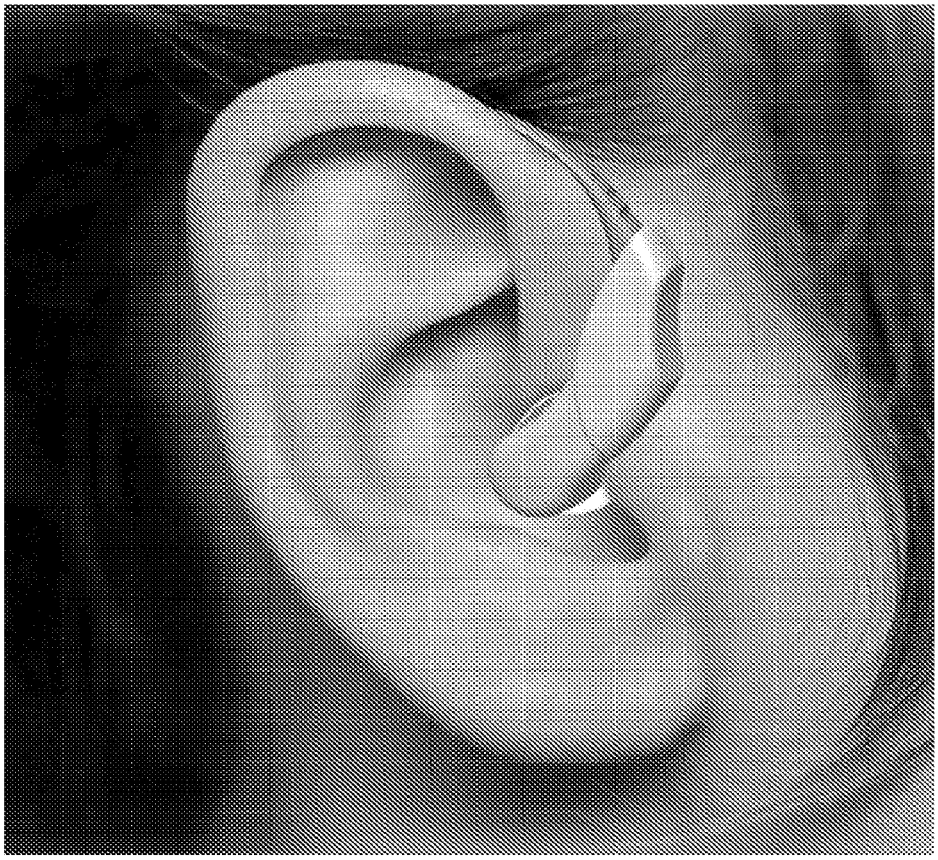

The housing 10 further comprises an outer ear section 24 that is connected to the earpiece 12 for accommodation of hearing device components and adapted for positioning at the outer ear in front of the pinna during use as shown in FIG. 14. The outer ear section 24 further comprises a bow 49 that is adapted to be positioned behind the pinna like spectacles and that is mechanically interconnected with the outer ear section 24. In the illustrated embodiment, the bow 49 and the outer ear section 24 form separate units that are manufactured in separate pieces. The bow 49 assists in retaining the housing 10 at the outer ear in front of the wearer's pinna during use.

The outer ear section 24 and the earpiece 12 are interconnected with a substantially rigid sound tube 20 (not visible). The sound tube 20 provides a sound propagation path for sound signals emitted by a receiver (not shown) positioned in the outer ear section 24 of the hearing device 10 to the output port 16 at the end of the earpiece 12 for transmission of the sound to the eardrum (not shown) in the ear canal 14. The sound tube 20 is flexible in a direction perpendicular to the longitudinal extension of the tube 20; however, the tube 20 is substantially rigid, i.e. substantially not flexible (compressible or extendable), along its longitudinal direction thereby providing retention of the earpiece 12 in the ear canal 14 of the wearer. During positioning of the outer ear section 24 at the concha 26 and the helix 30 of the ear, the transverse flexibility of the tube 20 facilitates insertion of the earpiece 12 in the ear canal 14 and the rigidity of the tube 20 along its longitudinal extension will prevent the earpiece 12 from falling out of the ear canal 14 when the outer ear section is positioned at the outer ear in front of the pinna at the concha and helix as shown in FIG. 14.

The outer ear section 24 accommodates the hearing device components (not shown), such as the microphone(s), amplifier, battery, controls, electrical contacts and connectors, etc.

The earpiece of the embodiment shown in FIGS. 13 and 14 may be substituted with the dome 12 shown in FIG. 7.

In one or more embodiments described herein, the canal section may be an open canal section.

Sound signals may propagate as acoustic signal from a receiver positioned in the outer ear section of the hearing device and through a sound tube to an output port at the end of the canal section (which may have a form of an earpiece) for transmission of the sound to the eardrum in the ear canal.

Sound signals may alternatively propagate as electrical signals from the output of a signal processor in the outer ear section and through the sound tube to a receiver 80 in the canal section (which may have a form of an earpiece) that is positioned for emission of sound through the output port of the canal section.

The invention claimed is:

1. A hearing aid, comprising:

an outer ear section comprising a microphone for converting sound into an audio signal, and a signal processor for processing the audio signal into a compensated audio signal;

a receiver that is connected to an output of the signal processor for converting the processed compensated audio signal into an acoustic signal;

an open and flexible earpiece that is adapted for fitting in an ear canal of a wearer, the flexible earpiece having a vent, a depth of the vent being shorter than a length of the earpiece measured along a longitudinal axis of the earpiece, the earpiece having an output port for emission of the acoustic signal towards an eardrum of the wearer when the earpiece is inserted in the ear canal; and a sound tube that is substantially rigid in its longitudinal direction and flexible perpendicular thereto, and interconnects the outer ear section and the earpiece;

wherein the outer ear section does not obstruct the ear canal so that the earpiece can provide a venting effect.

2. The hearing aid according to claim 1, further comprising a system for feedback cancellation.

3. The hearing aid according to claim 1, further comprising a resilient fibre that is connected to the earpiece for abutting a surface of an outer ear when the earpiece has been inserted in the ear canal thereby providing retention of the earpiece in the ear canal of the wearer.

4. The hearing aid according to claim 1, wherein the outer ear section further comprises a helix section that is adapted to be positioned in a helix of the ear of the wearer and that is mechanically interconnected with a part of the outer ear section through a bridge section.

5. The hearing aid according to claim 1, wherein the sound tube is provided for transmission of the acoustic signal from the receiver positioned in the outer ear section to the output port of the earpiece.

6. The hearing aid according to claim 1, wherein the flexible earpiece has a shape of a dome.

7. The hearing aid according to claim 1, wherein the flexible earpiece comprises a base, and a first sidewall that is attached to the base and has an edge that extends substantially from the base to an opening of the earpiece, wherein a width of the opening is smaller than a width of the ear canal of the wearer.

8. The hearing aid according to claim 7, wherein the flexible earpiece has a second sidewall, each of the first and second sidewalls has an edge that extends from adjacent parts of the base to the opening.

9. The hearing aid according to claim 1, wherein the flexible earpiece provides venting through a sound transparent sidewall, at least the edges of the sound transparent sidewall being sufficiently thin to be transparent to sound, thereby allowing sound to propagate through the earpiece in the ear canal without substantial attenuation.

10. The hearing aid according to claim 1, wherein the flexible earpiece comprises a vent opening.

11. The hearing aid according to claim 1, wherein the earpiece has a standard size.

12. The hearing aid according to claim 1, wherein the earpiece is configured to reduce an occlusion effect.

13. The hearing aid according to claim 1, wherein the outer ear section comprising the microphone is configured for placement in front of an ear of the wearer.

14. The hearing aid according to claim 1, wherein the earpiece has a tubular member with a first end and a second end, the tubular member having an opening at the second end and a lumen extending from the second end for accommodating a portion of the sound tube.

15. The hearing aid according to claim 14, wherein the longitudinal axis of the earpiece is defined by the first end and the second end.

16. The hearing aid according to claim 1, wherein at least a part of the earpiece is configured for placement in an outer part of the ear canal.

17. The hearing aid according to claim 13, wherein the outer ear section is configured for placement outside the ear canal.

18. The hearing aid according to claim 1, wherein the receiver is at the earpiece.

19. The hearing aid according to claim 18, wherein the sound tube is configured to transmit the processed compensated audio signal in electrical form to the receiver at the earpiece.

20. The hearing aid according to claim 1, wherein the receiver is at the outer ear section.

21. The hearing aid according to claim 20, wherein the sound tube is configured to transmit the acoustic signal to the earpiece.

22. The hearing aid according to claim 1, wherein the receiver and the flexible earpiece are different components.

23. The hearing aid according to claim 1, wherein the vent of the flexible earpiece is defined by a material that forms the flexible earpiece.

* * * * *